US008821219B2

(12) United States Patent
Ahn et al.

(10) Patent No.: US 8,821,219 B2
(45) Date of Patent: Sep. 2, 2014

(54) WAFER UNLOADING SYSTEM AND WAFER PROCESSING EQUIPMENT INCLUDING THE SAME

(75) Inventors: Jin-Woo Ahn, Daejeon (KR); Eun-Suck Choi, Gumi-si (KR); Bong-Woo Kim, Gumi-si (KR); Hwan-Su Yu, Gumi-si (KR); Jae-Hwan Yi, Gumi-si (KR)

(73) Assignee: Siltron Inc., Gyeongbuk (KR)

( * ) Notice: Subject to any disclaimer, the term of this patent is extended or adjusted under 35 U.S.C. 154(b) by 797 days.

(21) Appl. No.: 13/008,896

(22) Filed: Jan. 18, 2011

(65) Prior Publication Data

US 2011/0177762 A1 Jul. 21, 2011

(30) Foreign Application Priority Data

Jan. 15, 2010 (KR) ..... 10-2010-0003808

(51) Int. Cl.
*B24B 7/17* (2006.01)
*B24B 37/34* (2012.01)

(52) U.S. Cl.
CPC ..... *B24B 37/345* (2013.01)
USPC ..... 451/262; 451/267; 451/339

(58) Field of Classification Search
CPC ..... B24B 37/08; B24B 37/28; B24B 7/17; B24B 7/228; H01L 21/02024; H01L 21/30625
USPC ..... 451/65, 66, 262–269, 285–288, 290, 451/398, 402
See application file for complete search history.

(56) References Cited

U.S. PATENT DOCUMENTS

| | | | | |
|---|---|---|---|---|
| 6,139,408 | A * | 10/2000 | Hakomori | 451/267 |
| 6,149,498 | A * | 11/2000 | van Kessel et al. | 451/28 |
| 6,149,759 | A * | 11/2000 | Guggenberger | 156/345.51 |
| 7,160,808 | B2 * | 1/2007 | Kassir | 438/690 |
| 2007/0077867 | A1 * | 4/2007 | Nakahata | 451/41 |
| 2007/0224920 | A1 * | 9/2007 | Nakagawa et al. | 451/41 |

FOREIGN PATENT DOCUMENTS

| | | | |
|---|---|---|---|
| JP | 58-122733 | | 7/1983 |
| JP | 2002-083786 | A | 3/2002 |
| JP | 2003-234317 | A | 8/2003 |
| JP | 2005-230978 | | 9/2005 |
| JP | 2009-529246 | | 8/2009 |
| KR | 10-1999-0069594 | A | 9/1999 |
| KR | 10-2001-0018712 | A | 3/2001 |
| KR | 10-2010-0003808 | A | 6/2011 |
| WO | WO 2007/103703 | A2 | 9/2007 |

OTHER PUBLICATIONS

International Search Report dated Jun. 27, 2011 in corresponding International Patent Application No. PCT/KR2010/009011 filed Dec. 16, 2010.

Japanese Patent Application No. 2012-548875, Office Action dated Oct. 22, 2013 (No English Translation provided).

* cited by examiner

*Primary Examiner* — Timothy V Eley

(74) *Attorney, Agent, or Firm* — Lewis Roca Rothgerber LLP

(57) ABSTRACT

A wafer unloading system and wafer processing equipment (system) including the same are disclosed. The wafer unloading system includes a fluid supply tube for supplying a fluid, a nozzle for injecting the supplied fluid, and an injection hole defined in a plate to allow the injected fluid to reach a space between a polishing pad and a wafer.

4 Claims, 2 Drawing Sheets

WAFER UNLOADING SYSTEM AND WAFER PROCESSING EQUIPMENT INCLUDING THE SAME

CROSS-REFERENCE TO RELATED APPLICATION

This application claims the priority benefit of Korean patent application number 10-2010-0003808 filed Jan. 15, 2010, the disclosure of which is incorporated by reference.

BACKGROUND OF THE INVENTION

1. Field of the Invention

The present disclosure relates to a wafer unloading system and a wafer processing equipment including the same.

2. Description of the Related Art

According to the related art, a lapping machine or a double side polishing machine for processing both side surfaces of a wafer is effectively controlled in shape or flatness when compared to an existing single side polishing machine for processing one side of the wafer. Unlike the single side polishing machine, since the double side polishing machine does not support the wafer, the double side polishing machine polishes the wafer using a carrier for preventing the wafer from being separated during the polishing. In the instance where both side surfaces of the wafer are polished using the carrier, the wafer may be broken in a process in which the wafer is absorbed to a pad due to surface tension of a fluid between the pad attached to a lower plate and the wafer after polishing and a pressure applied during the processing and is unloaded.

The double side polishing machine has an advantage to improve the entire shape and flatness. Since the wafer may be easily broken by the surface tension due to the fluid between the pad and wafer, however, when the wafer is unloaded after polishing, it is difficult to apply the double side polishing machine to automatic loading equipment. Such an unloading limitation due to the surface tension may more strongly affect the wafer processing process because the wafer is increased in diameter to increase a contact area.

SUMMARY OF THE INVENTION

Embodiments of the claimed invention provide a wafer unloading system in which a wafer absorbed on a plate is easily unloaded after a polishing process is effectively performed in a lapping machine of polishing both side surfaces of the wafer at the same time or a double side polishing machine and a wafer processing equipment including the same.

In one embodiment, a wafer unloading system includes a fluid supply tube for supplying a fluid, a nozzle for injecting the supplied fluid, and an injection hole defined in a plate to allow the injected fluid to reach a space between a polishing pad and a wafer.

In another embodiment, wafer processing equipment in which a wafer is disposed and processed between an upper plate polishing pad and a lower plate polishing pad includes a wafer unloading structure in which a fluid is supplied between the lower plate polishing and the wafer.

DETAILED DESCRIPTION

Figure 1:
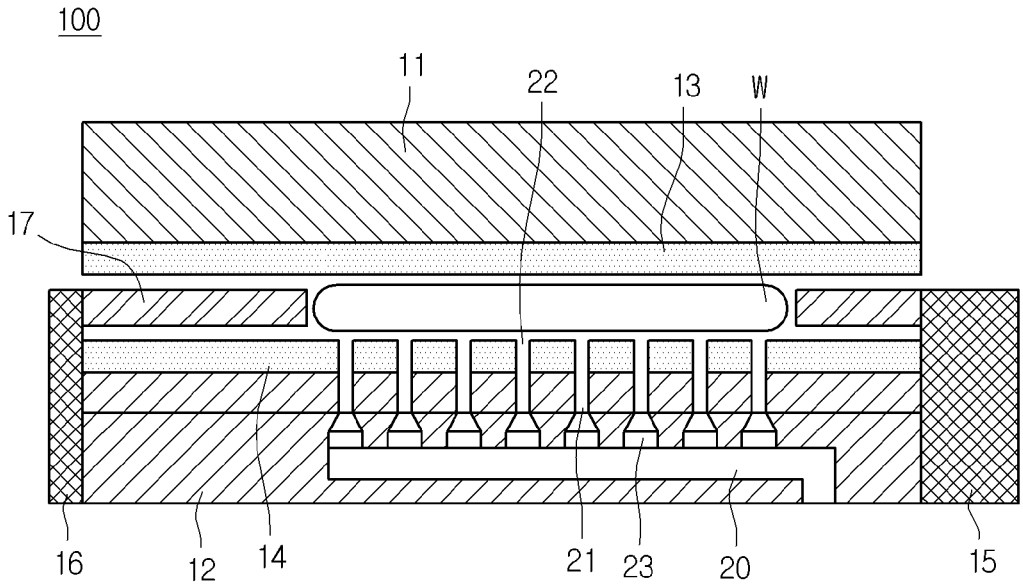
FIG. 1 is a sectional view of wafer processing equipment.

The details of one or more embodiments are set forth in the accompanying drawings and the description below. Other features will be apparent from the description and drawings, and from the claims.

In the descriptions of embodiments, it will be understood that when a wafer, a device, a chuck, a member, a part, a region, or a surface is referred to as being 'on' a wafer, a device, a chuck, a part, a region, or a surface, it can be directly on another layer or substrate, or intervening layers may also be present. Further, it will be understood that when a layer is referred to as being 'under' another layer, it can be directly under another layer, and one or more intervening layers may also be present. Further, the reference about 'on' and 'under' each layer will be made on the basis of drawings.

In the drawings, the size of each element is exaggerated for convenience in description and clarity. The size of each element does not necessarily reflect an actual size.

FIG. 1 is a sectional view of wafer processing equipment 100. The wafer processing equipment according to an embodiment in which a wafer W may be disposed and processed between an upper plate polishing pad 13 and a lower plate polishing pad 14 may have a wafer unloading structure 50 (see FIG. 2) in which a fluid is supplied between the lower plate polishing pad 14 and the wafer W.

The wafer processing equipment according to an embodiment may be a wafer double side polishing machine, but is not limited thereto. Although the double side polishing machine is illustrated to explain the wafer processing equipment in the current embodiment, the present disclosure is not limited thereto. For example, the wafer processing equipment may include a lapping machine in which both side surfaces of the wafer W is processed at the same time.

In the currently described embodiment, the wafer processing equipment 100 may include a rotatable lower plate 12, a vertically movable upper plate rotatably disposed over the lower plate 12, a sun gear 15 rotatably disposed on a portion of an outside of the lower plate 12, an internal gear 16 rotatably disposed on an outer circumference of the lower plate 12, and a carrier 17 disposed between the sun gear 15 and the internal gear 16.

The lower plate polishing pad 14 may be disposed on a top surface of the lower plate 12. A bottom surface of the wafer W supported by the carrier 17 may contact a top surface of the lower plate polishing pad 14.

The upper plate polishing pad 13 may be disposed on a bottom surface of the upper plate 11. Also, a top surface of the wafer W supported by the carrier 17 may contact a bottom surface of the upper polishing pad 13. The upper plate 11 may vertically ascend or descend.

The sun gear 15 may be rotatably disposed on a central portion of the lower plate 12. The sun gear 15 may be connected to a driving source (not shown) disposed under the lower plate 12 and rotatable in a horizontal direction.

The internal gear 16 may be freely disposed on the outer circumference of the lower plate 12. The internal gear 16 may be connected to the driving source disposed under the lower plate 12 and rotatable in the horizontal direction.

When the sun gear 15 and the internal gear 16 are rotated, the carrier 17 may revolve and rotate around the sun gear 15. The carrier 17 may be provided in plurality between the sun gear 15 and the internal gear 16 with a predetermined distance.

In the processing equipment 100, a predetermined wafer loading machine (not shown) is operated to load the wafer W on the carrier 17. Thereafter, the upper plate 11 may descend to fit and support each of the wafers W between the lower plate 12 and the upper plate 11. Then, the lower plate 12, the upper plate 11, the sun gear 15, and the internal gear 16 may be rotated to polish the top and bottom surfaces of the wafer W at the same time.

Figure 4:
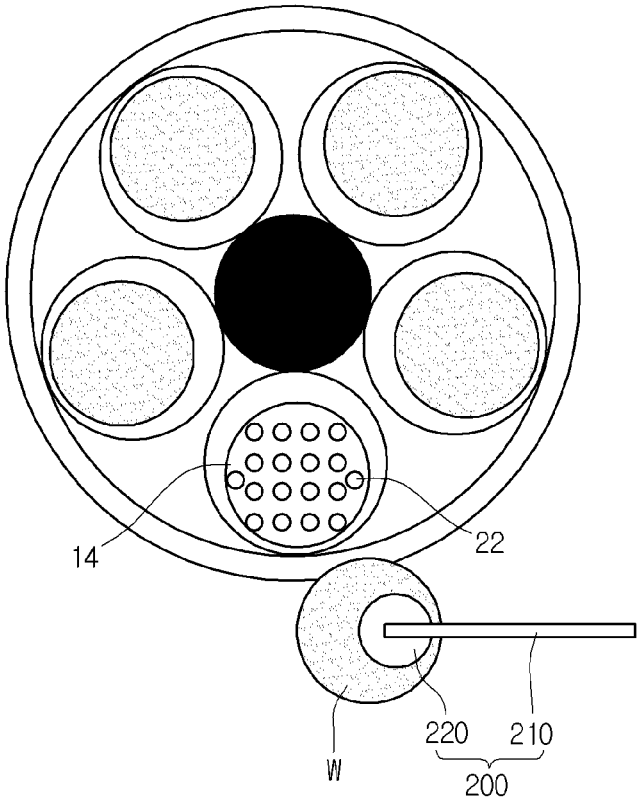
FIG. 4 also illustrates an unloading operation of wafer processing equipment.

After the top and bottom of the wafer W is completely processed, the wafer W may be unloaded by a predetermined external wafer unloading machine 200 (see FIG. 4). Here, the wafer W may be easily unloaded using the wafer unloading structure 50.

Figure 2:
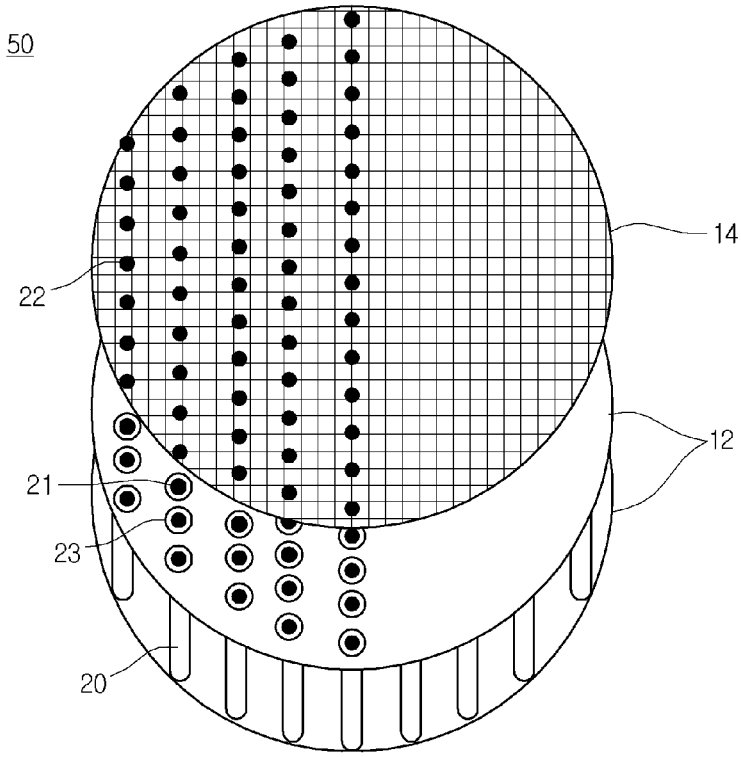
FIG. 2 illustrates a wafer unloading system.

FIG. 2 illustrates an example of a wafer unloading system. The wafer unloading system 50 according to an embodiment may include the wafer unloading structure 50, but is not limited thereto.

The wafer unloading structure 50 according to an embodiment may include a fluid supply tube 20 for supplying a fluid, a nozzle 23 for injecting the supplied fluid, an injection hole 22 defined in the lower plate 12 to allow the injected fluid to reach a space between the lower plate polishing pad 14 and the wafer W.

The wafer unloading structure 50 may include the fluid supply tube 20 for allowing the fluid to flow into the lower plate 12 of the processing equipment 100. The wafer unloading structure 50 may include the nozzle 23 for injecting the fluid from the fluid supply tube 20. The injection hole 22 is defined in the lower plate polishing pad 14 to correspond to a nozzle tube 21 of the lower plate 12 so that the fluid injected from the nozzle 23 reaches a surface of the lower plate polishing pad 14. Thus, the injected fluid may reach the space between the lower plate polishing pad 14 and the wafer W. Accordingly, since the injected fluid may be supplied between the wafer W and the lower plate polishing pad 14 after polishing, the wafer W absorbed by a surface tension of the fluid may be more easily unloaded.

Positions of the nozzles 23 illustrated as dots in FIG. 2 are for emphasizing that the nozzles 23 are disposed at the same position as those of the injection holes 22 on a surface of the lower plate polishing pad 14. Thus, the present disclosure is not limited to the positions of the nozzle 23.

The wafer unloading structure 50 may further include a branching part (not shown) for branching the fluid supplied into the lower plate 12 to inject the fluid onto an entire surface of the lower plate 12 or specific positions desired by a user. In one embodiment, the fluid may include at least one of gas and liquid. For example, the fluid introduced for unloading the wafer W may include at least one or more of ultra-pure water, ozone water, hydrogen water, and SC1 (standard clean 1) cleaning solution. The SC1 may be a mixture of $NH_4OH$:$H_2O_2$:$H_2O$ with the volume ratio of 1:4:20 or x:1:5, but is not limited thereto.

In the instance where the functional water such as ozone water and hydrogen water and the chemical solution such as SC1 are used as the fluid, the functional water and chemical solution may improve a cleaning effect in which a residue remaining on the surface of the wafer W is removed after polishing and growth of an oxide layer and be coupled to a dangling bond of the surface of the wafer W using surplus hydrogen H radicals to stabilize the surface of the wafer W. The fluid that is in a gas state may include at least one or more of nitrogen $N_2$, inert gas, and air.

In the wafer unloading system and the wafer processing equipment including the same, a plurality of holes may be defined in the lower plate of the lapping machine for polishing both side surfaces of the wafer at the same time or the double side polishing machine. Thus, the surface tension between the wafer W and the pad may be weakened using the fluid to easily unload the wafer W.

Figure 3:
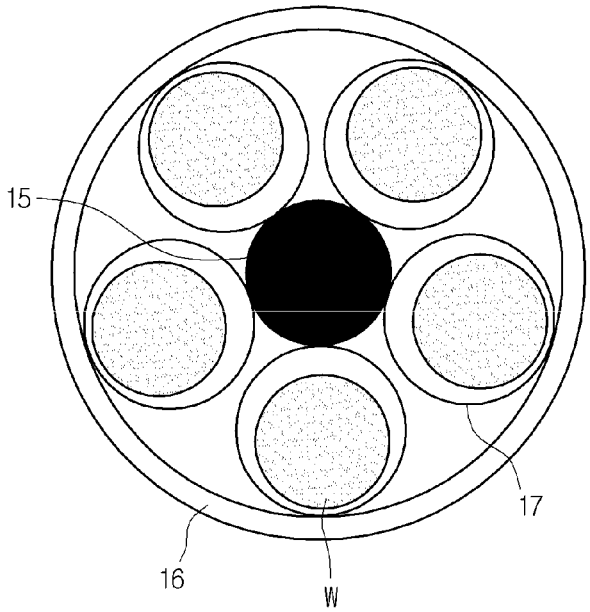
FIG. 3 illustrates an unloading operation of wafer processing equipment.

FIGS. 3 and 4 illustrate examples of an unloading operation of the wafer processing equipment (system). Referring to FIG. 3 and FIG. 1, as described above, after both side surfaces of the wafer W are completely processed, the fluid supplied through the lower plate 12 may be injected onto the surface of the lower plate polishing pad 14 to weaken the surface tension between the wafer W and the lower plate polishing pad 14, thereby easily detaching the wafer W when the wafer is unloaded.

Thereafter, as shown in FIG. 4, in a state where the wafer is easily detachable, the wafer may be easily unloaded by the external wafer unloading machine 200 including an absorption pad 220 and an unloading member 210 without being broken. The above-described wafer unloading method may be applicable to a large-diameter wafer having a large area.

In the wafer unloading system and the wafer processing machine including the same, the fluid may be movable into the lower plate of the lapping machine for polishing both side surfaces of the wafer at the same time or the double side polishing machine to weaken the surface tension between the pad and the wafer after polishing to weaken the surface tension between the pad and the wafer, thereby easily unloading the wafer. For example, in the wafer unloading system according to an embodiment and the wafer processing machine including the same, the plurality of holes may be defined in the lower plate of the lapping machine for polishing both side surfaces of the wafer at the same time or the double side polishing machine. Thus, the surface tension between the wafer W and the pad may be weakened using the fluid to easily unload the wafer W. According to an embodiment, the unlading limitation due to the increase of the surface intension by increasing the contact area because of the large-diameter wafer may be solved.

Features, structures, and effects described in the above embodiments are incorporated into at least one embodiment of the present invention, but are not limited to only one embodiment. Moreover, features, structures, and effects exemplified in one embodiment can easily be combined and modified for another embodiment by those skilled in the art. Therefore, these combinations and modifications should be construed as falling within the scope of the present invention.

Although embodiments have been described with reference to illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims.

Although the double side polishing machine is illustrated to explain the wafer processing equipment 100 according to the embodiment, the present disclosure is not limited thereto. For example, the wafer processing equipment may include the lapping machine in which both side surfaces of the wafer W is processed at the same time.

In the wafer unloading system and the wafer processing machine including the same, the fluid may movable into the lower plate of the lapping machine for polishing both side surfaces of the wafer at the same time or the double side polishing machine to weaken the surface tension between the pad and the wafer after polishing to weaken the surface tension between the pad and the wafer, thereby easily unloading the wafer. The unlading limitation due to the increase of the surface intension by increasing the contact area because of the large-diameter wafer may be solved.

Any reference in this specification to "one embodiment," "an embodiment," "example embodiment," etc. means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A wafer processing system, the wafer processing system comprising:

an upper plate polishing pad;

a lower plate polishing pad, whereby a wafer is disposed and processed between the upper plate and lower plate polishing pad; and a wafer unloading structure in which a fluid is supplied between the lower plate polishing pad and the wafer;

a lower plate disposed under the lower plate polishing pad;

wherein the wafer unloading structure includes:

a fluid supply tube for supplying the fluid, a nozzle for injecting the supplied fluid, an injection hole defined in the lower plate polishing pad to allow the injected fluid to reach a space between the lower plate polishing pad and the wafer; and a nozzle tube through which the injected fluid is movable into the injection hole, wherein the fluid supply tube, the nozzle and the nozzle tube are disposed in the lower plate, wherein the injection hole is defined in the lower plate polishing pad to correspond to the nozzle tube of the lower plate.

2. The wafer processing system of claim 1, wherein the fluid comprises at least one or more of gas and liquid.

3. The wafer processing system of claim 2, wherein the fluid that is in a liquid state comprises at least one or more of ultra-pure water, ozone water, hydrogen water, and SCI (standard clean 1) cleaning solution.

4. The wafer processing system of claim 2, wherein the fluid that is in a gas state comprises at least one or more of nitrogen N2, inert gas, and air.

* * * * *